US006536887B2

(12) United States Patent
Barinaga et al.

(10) Patent No.: US 6,536,887 B2
(45) Date of Patent: Mar. 25, 2003

(54) OVER-MOLDED REGULATOR BAG FOR AN INK DELIVERY SYSTEM

(75) Inventors: Louis C. Barinaga, Salem, OR (US); Daniel D. Dowell, Albany, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/842,743

(22) Filed: Apr. 25, 2001

(65) Prior Publication Data

US 2002/0180845 A1 Dec. 5, 2002

(51) Int. Cl.[7] ..... B41J 2/175
(52) U.S. Cl. ..... 347/86
(58) Field of Search ..... 347/85, 86, 87; 264/250, 255, 267

(56) References Cited

U.S. PATENT DOCUMENTS 4,202,267 A * 5/1980 Heinzl et al. ..... 101/364
5,084,713 A * 1/1992 Wong ..... 347/18
5,116,902 A * 5/1992 Chapman et al. ..... 524/579
5,464,578 A * 11/1995 Salter et al. ..... 264/250
5,574,490 A * 11/1996 Gragg et al. ..... 347/87
5,975,330 A * 11/1999 Sasaki et al. ..... 220/495.01
6,158,853 A * 12/2000 Olsen et al. ..... 347/86

* cited by examiner

*Primary Examiner*—Michael Nghiem
(74) *Attorney, Agent, or Firm*—Larry D. Baker

(57) ABSTRACT

Over-molded regulator bags for a fluid delivery system are disclosed that are formed by over-molding a resilient bladder of an elastomeric material on a supporting rigid host substrate. The over-molding process allows three dimensional lung designs to be created without extra processes, and without stressing the membrane material. Embodiments of the invention eliminate the need for an external spring to create an opposing pressure to deflate the bags when required. The inherent elasticity of the over-molded bladders act as the restoring force to return the expanded bag back to its original form.

22 Claims, 8 Drawing Sheets

OVER-MOLDED REGULATOR BAG FOR AN INK DELIVERY SYSTEM

BACKGROUND OF THE INVENTION

1. Field of the Invention

The present invention relates generally to the field of fluid delivery systems and more are specifically, to a regulator bag for an ink delivery system.

2. Description of Related Art

Inkjet technology is relatively well developed. The basics of this technology are described by W. J. Lloyd and H. T. Taub in "Inkjet Devices," Chapter 13 on Output Hardcopy Devices (Ed. R. C. Durbeck and S. Sherr, Academic Press, San Diego, 1988) and in various articles in the Hewlett-Packard Journal, Vol. 36, No. 5 (May 1985), Vol. 39, No. 4 (August 1988), Vol. 39, No. 5 (October 1988), Vol. 43, No. 4, August 1992), Vol. 43, No. 6 (December 1992) and Vol. 45, No. 1 (February 1994).

The typical thermal inkjet print head has an array of precisely formed nozzles attached to a print head substrate that incorporates an array of firing chambers that receive liquid ink (i.e., colorants dissolved or dispersed in a solvent) from an ink reservoir. In what is sometimes referred to as a disposable print cartridge, the ink reservoir is an integral element with the print head, sometimes referred to as on-axis.

Alternatively, the pen can be a free-ink type print mechanism, where the ink is supplied to the print head mechanism from a separate, self-contained ink supply such as a biased ink bladder or bag (see U.S. Pat. No. 5,359,353, Hunt et al., assigned to the common assignee of the present application) sometimes referred to in the art as off-axis. An on-axis regulator mechanism is provided with the pen to control ink flow and print head pressure; one such regulator mechanism is disclosed by S. Dana Seccombe et al. in U.S. Pat. No. 5,650,811 for an Apparatus for Providing Ink to a Printhead (assigned to the assignee of the present application).

Each firing chamber has a thin-film resistor, known as a firing resistor or heater resistor, located opposite the nozzle such that ink can collect between the heater resistor and the nozzle. When electric printing pulses heat the print head firing resistor, a small portion of the ink near it vaporizes and ejects a drop of ink from the print head via a nozzle orifice. The nozzles are arranged in a matrix array. Properly sequencing the operation of each firing resistor causes alphanumeric characters or graphics images to form on paper as the print head is scanned across adjacently positioned print media and a dot matrix of ink drops is printed to form a graphics image and alphanumeric characters.

In an effort to reduce the cost and size of inkjet printers and to reduce the cost per printed page, engineers have developed inkjet printers having small, moving print heads that are connected to large stationary ink reservoirs by flexible ink tubes. This development is called "off-axis" printing. In such printers the mass of the print head is greatly reduced so that the cost of the print head drive system and the overall size of the printer can be minimized. In addition, separating the ink reservoir from the print head allows the ink to be replaced as it is consumed without requiring frequent replacement of the costly print heads.

With the development of off-axis printing has come the need for numerous flow restrictions to the ink between the ink reservoir and the print head. These restrictions include additional orifices, or ink ports, narrow conduits, and shut-off valves. To overcome these flow restrictions and also to provide ink drops reliably over a range of printing speeds, ink is now transported to the print head at an elevated pressure and a pressure reducer is added to deliver the ink to the print head at an optimum back pressure (an internal negative pressure gauged at the print head that is substantially less than the pressure at the ink reservoir and through the conduits).

One difficulty in the evolution of off-axis printing is the increasing need to maintain the back pressure of the ink at the print head to within as small a range as possible. Changes in back pressure greatly affect print density and print quality, and major changes in back pressure can cause either the ink to drool out of the nozzles or the print cartridge to deprime.

There are several causes for such changes in back pressure. One cause occurs when air (including both ambient air and gasses out gassed from the ink) is entrapped within the print cartridge and the print cartridge is subjected to changes in environmental parameters such as altitude and temperature. Back-pressure will be affected by changes in either the ambient atmospheric or the internal pressure conditions. Temperature variations may cause the ink and air within the ink-jet pen to contract or expand, affecting the back-pressure. Another cause of changes in back pressure is the delay between the time the print head starts to eject ink during on-demand printing and the time the pressure regulator actuates to restore the back pressure.

These complications, as well as the use of pressurized ink delivery systems, have resulted in a need for more accurate back pressure regulation at inkjet print heads and for more precise compensation techniques.

In a foam reservoir print cartridge, the capillary action of the foam will generally be sufficient to create the desired back-pressure. In a free-ink reservoir type ink-jet pen, a variable-volume, on-board, ink containment supply is often employed. For example, the reservoir may be of a biased, flexible material which can expand or contract, or an ink containment chamber may be provided which includes an internal pressure regulating device. In U.S. Pat. No. 4,509,602 (assigned to the assignee of the present invention), a spring pulls an ink-filled bladder membrane outwardly to create a slight negative pressure inside the ink reservoir. U.S. Pat. No. 4,677,447 (assigned to the assignee of the present invention) describes the use of a check valve in a printing device with an on-board ink reservoir that maintains a constant pressure difference between the ink reservoir and the ink-jet printhead. U.S. Pat. No. 4,992,802 (assigned to the assignee of the present invention) teaches the use of two pressure control mechanisms to extend the environmental operating range of an ink-jet pen. U.S. Pat. No. 5,650,811 (Seccombe et al.) for an Apparatus for Providing Ink to a printhead (assigned to the assignee of the present application) describes a diaphragm type pressure regulator located on-board an ink-jet pen using an off-board ink reservoir.

One type of back pressure regulator utilizes a regulator bag with a spring-loaded actuation lever (U.S. Pat. No. 5,975,686, Hauck, et al. Regulator for a Free-Ink Inkjet Pen, assigned to the assignee of the present application). The regulator bag may be made of multiple layers that are co-extruded (U.S. Pat. No. 6,196,669, Harvey, et al., High Durability pressure Control for Use in an Ink Delivery System, assigned to the assignee of the present application). In typical current bag designs, the shorn edges of the multi-layer-films are in direct fluidic contact with the ink.

This contact can allow the ink to attack the tie layer bonding the films together. The ink attack can lead to a loss of adhesion between the tie layer and the film, causing delamination among the film layers. Failure of the regulator bag can lead to lack of backpressure resulting in unacceptable print quality, or worse.

The film based regulator bags also require thermal forming to create the requisite "lung" geometry. The process of thermal forming stretches the bag in certain areas. This stretching can create stress the bag material, causing local changes in the film properties (such as water vapor transmission rate and oxygen transmission rate), and weakening the bag.

Another regulator design consists of a bag with an interior spring captured between the side lungs (see, for example, U.S. Pat. No. 5,440,333, Sykora et al., Collapsible Ink Reservoir with Protective Bonding Layer for the Pressure Regulator, and U.S. Pat. No. 5,450,112, Scheffelin, Laminated Film for Ink Reservoir, both assigned to the assignee of the present application). This type of regulator bag is similar in function, but uses an interior spring, rather than an exterior spring, to create forces to oppose the internal pressure. These designs required semi-complex manufacturing methods, including spring forming and second shot molding onto the pen body.

As the art of inkjet printing continues to mature, there is a continuing need for printer components that are lower in cost, easier to handle, require fewer critical tolerances, and yet provide improved reliability. Further, there is a need for assembled components that have lower part counts and are easier to assemble. Lastly, there is an ongoing need for robust fluidic seals and ink conduits for the ink delivery systems in inkjet printing systems.

SUMMARY OF THE INVENTION

Embodiments of the present invention comprise over-molded regulator bags for a fluid delivery system. The regulator bags are formed by over-molding a resilient bladder of an elastomeric material on a supporting rigid host substrate. The over-molding process allows three dimensional lung designs to be created without extra processes, and without stressing the membrane material.

Embodiments of the invention eliminate the need for an external spring to create an opposing pressure to deflate the bags when required. The inherent elasticity of the over-molded bladders act as the restoring force to return the expanded bag back to its original form.

Over-molding also allows for multiple bladders to be created in single manufacturing process, thus enabling more complex, yet cost effective, ink delivery systems.

Other aspects and advantages of the present invention will become apparent from the following detailed description, taken in conjunction with the accompanying drawings, illustrating by way of example the principles of the invention.

DESCRIPTION OF THE PREFERRED EMBODIMENT

Figure 1:
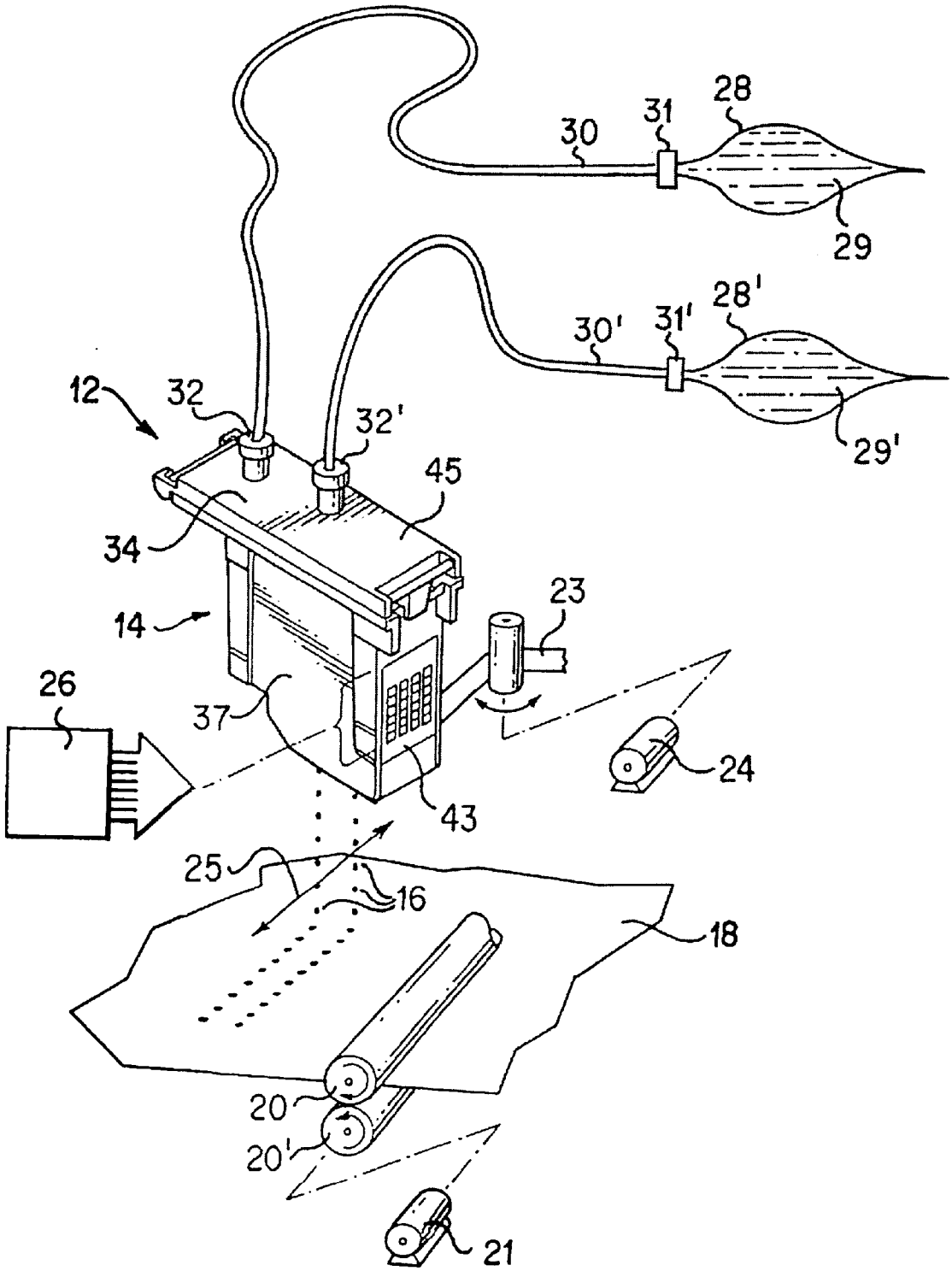
FIG. 1 is a schematically-illustrated view (for background information purposes) of the components, materials, and processes used in a representative ink delivery system which may be employed in connection with the present invention.

FIG. 1 depicts an exemplary printing system in which embodiments of the regulator bag of the present invention may be used. Referring to FIG. 1, reference numeral 12 generally indicates a printer including a print mechanism 14 that ejects drops 16 of ink on command. The drops form images on a printing medium 18 such as paper. The printing medium is moved laterally with respect to the print mechanism 14 by two print rollers 20, 20' and a motor 21 that engages the printing medium. The print mechanism is moved back and forth across the printing medium by a drive belt 23 and a motor 24. The motion of the print mechanism caused by the drive belt 23 and the motor 24 defines the scan axis 25. The print mechanism contains a plurality of firing resistors, not shown, that are energized on command by an electrical circuit 26. The circuit sequentially energizes the firing resistors in a manner so that as the print mechanism 14 moves laterally across the paper and the paper is moved by the rollers 20, 20', the drops 16 form images on the printing medium 18.

In FIG. 1, there are two ink reservoirs 28, 28' that are flaccid bags that each contain ink 29, 29'. Embodiments of the present invention may also be utilized in printing systems have only one ink reservoir per print mechanism, or in print systems having three or more ink reservoirs per print mechanism. Although not required, the ink 29, 29' in each bag may be pressurized up to a level of +100 inches of water for delivery to the print mechanism 14. The ink reservoirs 28, 28' are each connected to a conduit of flexible tubing 30, 30' by a fluid interconnect 31, 31'. The tubing 30, 30' terminates at a fluid interconnect 32, 32' located on the print mechanism 14. Thus, fluid communication is established between the ink reservoirs 28, 28' and the print mechanism 14.

Figure 2:
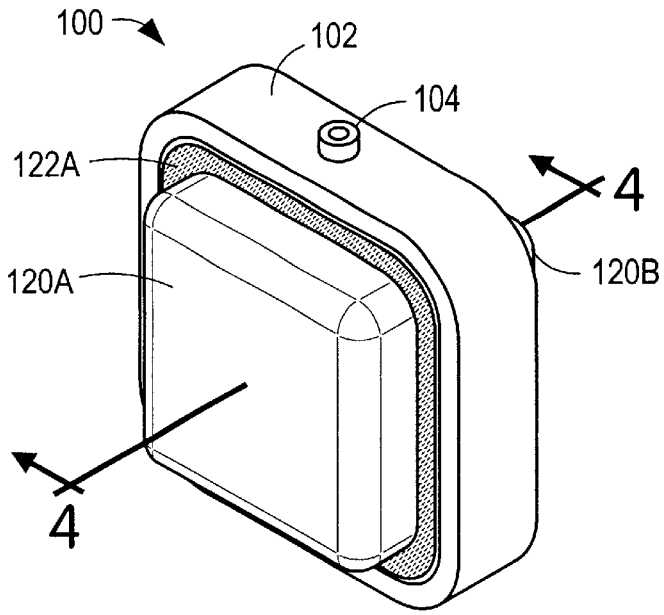
FIG. 2 is an isometric view of a first embodiment of the over-molded regulator bag of the present invention.

FIG. 2 is an isometric view of an embodiment of the regulator bag of the present invention. The regulator bag is contained inside the print mechanism 14 of FIG. 1, and serves as an expanding and contracting "lung", as in prior art regulator bags. The bag comprises a rigid central fitment member 102 with over-molded flexible bag members 120A, 120B attached to each side. The central fitment includes a raised boss 104 and hole at the top of the fitment to provide an air path for the regulator bag to "breath " to the atmosphere to adjust for bag volumetric changes. When used in an ink delivery system, this air inlet accommodates an insert (not shown) with a labyrinthine air path to allow air to enter and leave the bag, but to minimize water loss from the ink due to evaporation. A portion of the rigid host substrate 122A supporting the bag 120A is visible in FIG. 2.

Figure 3:
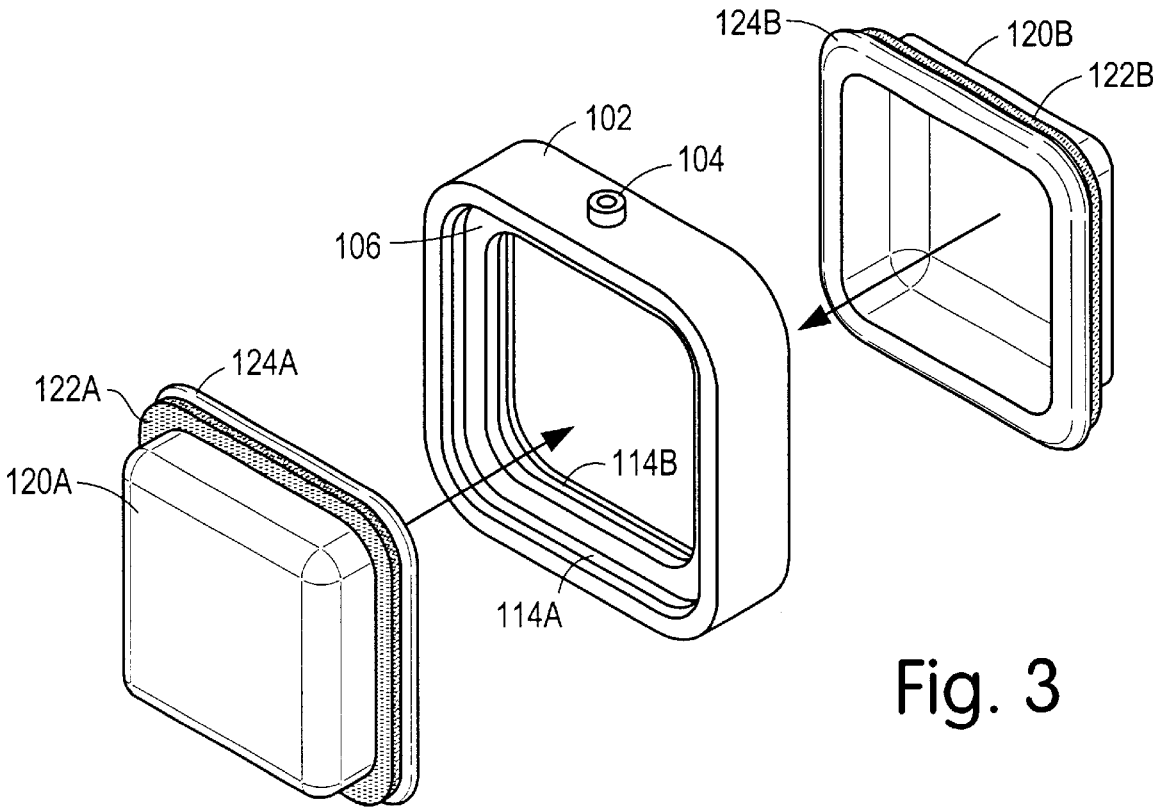
FIG. 3 is an exploded isometric view of the first embodiment of the over-molded regulator bag of the present invention.
Figure 4:
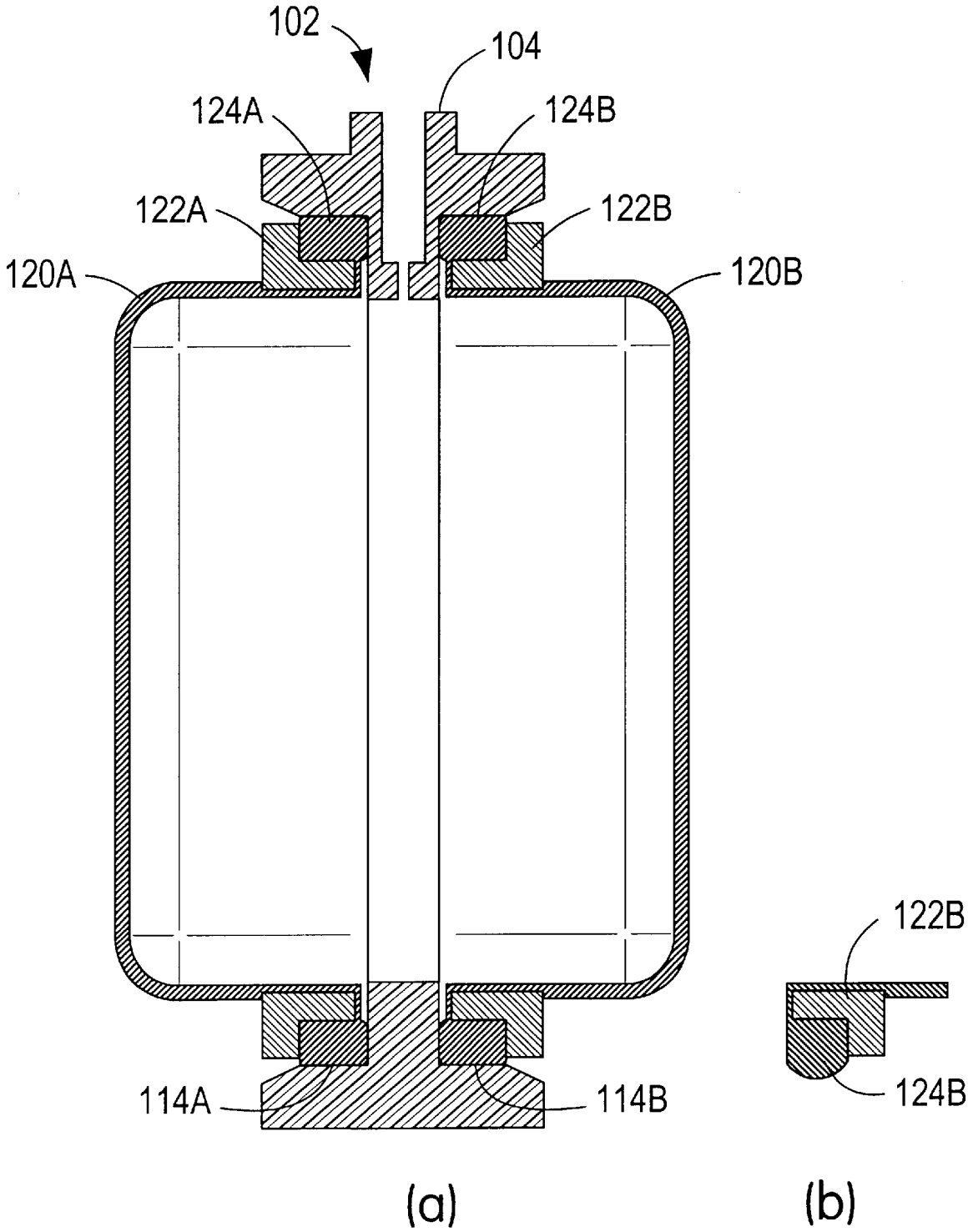
FIG. 4(*a*) is a sectional view of the first embodiment of the over-molded regulator bag of the present invention along section 4—4 of FIG. 2, with FIG. 4(*b*) illustrating an uncompressed gland seal for comparison.

In one embodiment of the bag, over-molded gland seals 124A, 124B are used to fluidically seal the bags to the central fitment member 102, as seen in exploded view in FIG. 3 and in cross section in FIG. 4. When assembled, the gland seals compress against flat inside surfaces 114A, 114B in the central fitment member 102, forming seals equivalent to O-rings. A dividing wall 106 in the central fitment member serves to back the two bags when the bags are mated with the central support. To mechanically retain the bags to the central fitment, any of the commonly used attachment methods may be used, such as snaps or ultrasonic welds (not shown).

In the preferred embodiment of the regulator bag, the rigid substrates 122A, 122B are made of plastic, and are produced using traditional injection molding techniques. The substrate is then transferred to a second mold cavity, where an elastomer membrane is over-molded onto the substrate to simultaneously create both one half of a "lung" shaped regulator bag 120A, 120B, and the gland seal 124A, 124B. The rigid host substrate acts as a host part, onto which the bag is molded and retained. It should be noted that the geometry of each half of the bag is created during a single over-mold operation, and that the geometry allows for a single action mold tool (no slides required) to create the lung feature.

Each of the gland seals 124A, 124B consists of an over-molded lip that has a circular cross section. Other cross sectional shapes are also known in the art and may be used. This lip runs around the entire perimeter of the lung, and is backed by the rigid host substrate 122A, 122B. When the lung is pressed onto the fitment, the gland seal interferes with the wall of the fitment, creating a fluid tight seal (equivalent to an O-ring). This type of seal is ideal for use in ink because it is a low stress seal.

The elastomeric nature of the over-mold allows the bag to have a natural restoring force. When stretched by pressure changes in the regulator chamber, the bag will naturally try to pull itself back to its original shape. The inherent elasticity of the over-molded bag will act as the restoring force to return the expanded bag back to its original form. This feature eliminates the need for an external spring to contract the bag.

The present invention solves the problem of film edge attack in regulator bags by changing the fundamental technology used to create the bag. Rather than using film that is sheared and staked, this invention uses over-molding technology to create a regulator bag on a host substrate.

FIG. 4(*a*) is a cross section view of an embodiment of the regulator bag along line 4—4 of FIG. 2. It may be observed how the lip of each gland seal 124A, 124B engages the flat inside surfaces 114A, 114B in the central fitment 102. For comparison, a cross section of an uncompressed seal is shown in FIG. 4(*b*).

Figure 5:
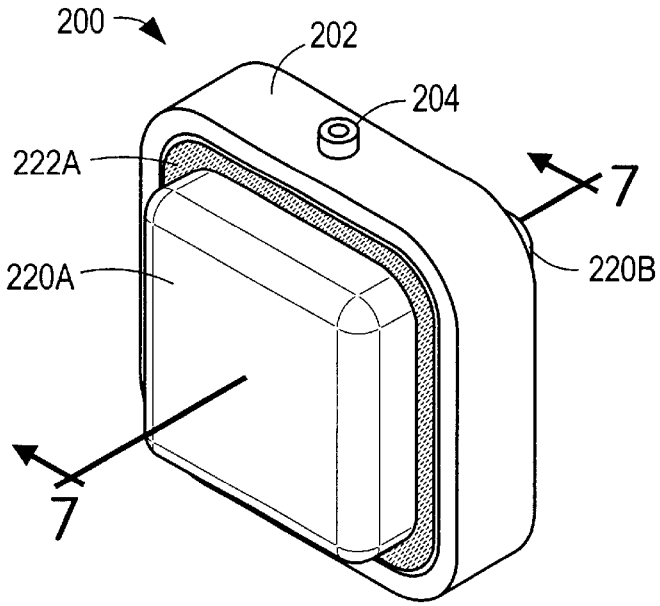
FIG. 5 is an isometric view of a second embodiment of the over-molded regulator bag of the present invention.
Figure 6:
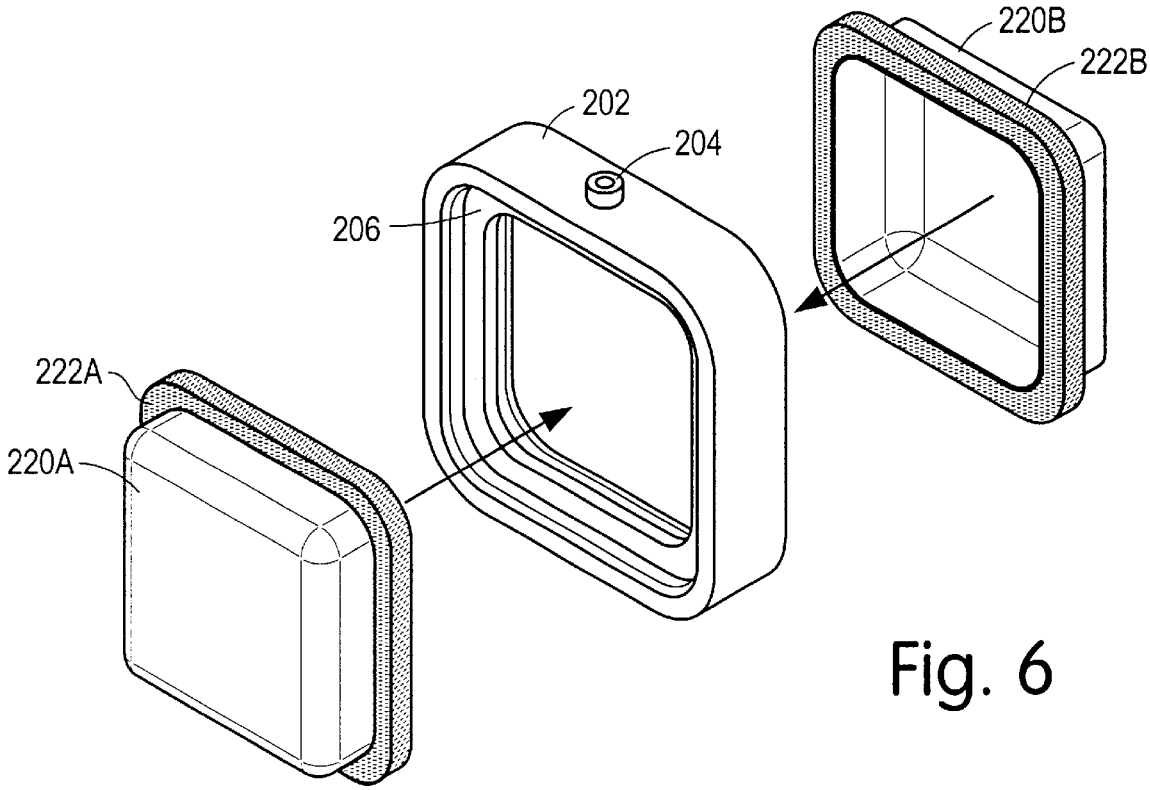
FIG. 6 is an exploded isometric view of the second embodiment of the over-molded regulator bag of the present invention
Figure 7:
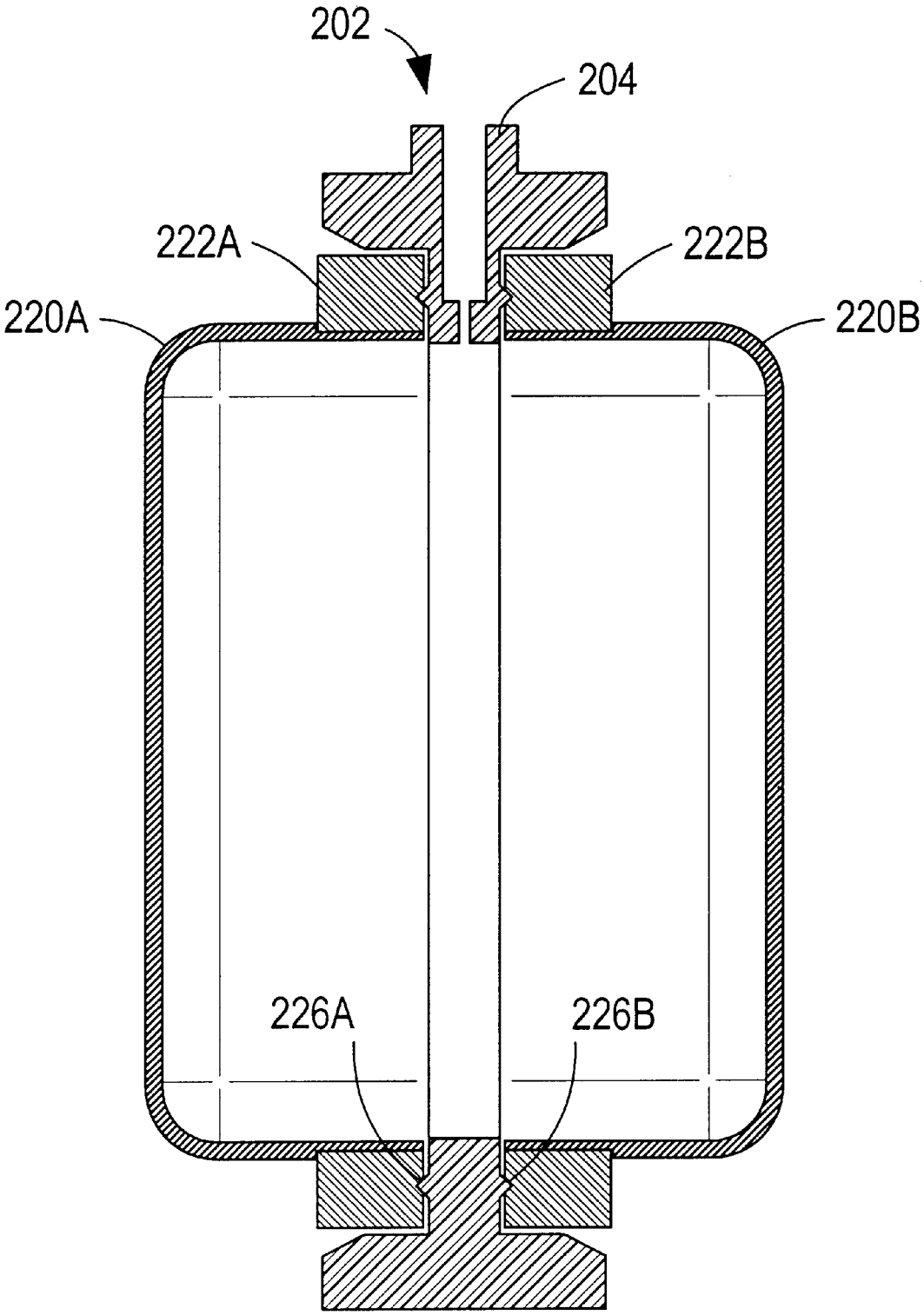
FIG. 7 is a sectional view of the second embodiment of the over-molded regulator bag of the present invention along section 7—7 of FIG. 5.

FIG. 5, FIG. 6, and FIG. 7 depict another embodiment of the regulator bag, in which ultrasonic welds, rather than gland seals, are used to fluidically seal the rigid host substrates of the over-molded flexible bag members 220A, 220B to the center fitment 204. As seen in isometric view FIG. 5, the bag is externally similar to the embodiment using gland seals, with a rigid central fitment member 202 and over-molded flexible bag members 220A, 220B attached to each side. The central fitment includes a raised boss 204 and hole at the top of the fitment to provide an air path for the regulator bag to "breath " to the atmosphere to adjust for bag volumetric changes. A portion of the rigid host substrate 222A supporting the bag 220A is visible in FIG. 5.

As seen in FIG. 6, rather than having gland seals, this embodiment of the regulator bag has rigid host substrates 222A and 222B which abut the dividing wall 206 of the central fitment. As seen in cross section in FIG. 7, ultrasonic welds 226A, 226B mechanically attach the bag members to the central fitment, and provide a fluid-tight seal for the bag.

Figure 8:
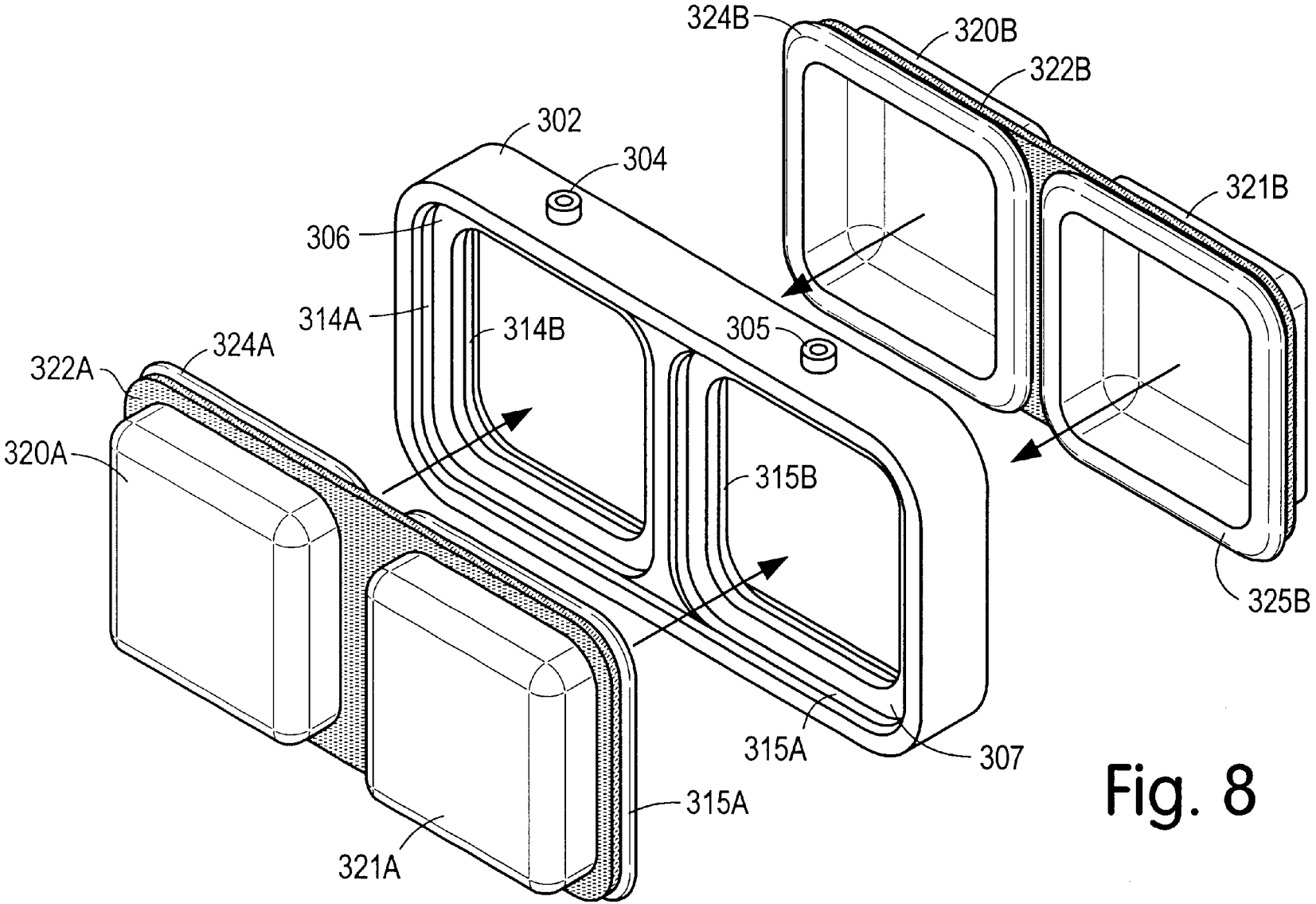
FIG. 8 is an isometric view of an embodiment of the over-molded regulator bag of the present invention.

The method of producing the regulator bag of the present invention is adaptable to producing more complex components, such as multiple regulator bags, as depicted in FIG. 8. An advantage of the over-molding process is that the production of more complex assemblies is accomplished using more complex molds, without requiring additional assembly steps. As seen in FIG. 8, a central fitment 302 is provided with mating surfaces for two regulator bags, including flat inside surfaces 314A, 314B, 315A, 315B and dividing walls 306 and 307. The fitment also has two raised bosses 304, 305 with holes to provide air paths. Each rigid host substrate 322A and 322B holds two elastomeric bag members (320A, 321A and 320B, 321B, respectively). Gland seals 324A, 325A, 324B, and 325B mate with grooves 314A, 315A, 314B, and 315B, respectively, when the multiple regulator bag is assembled.

Figure 9:
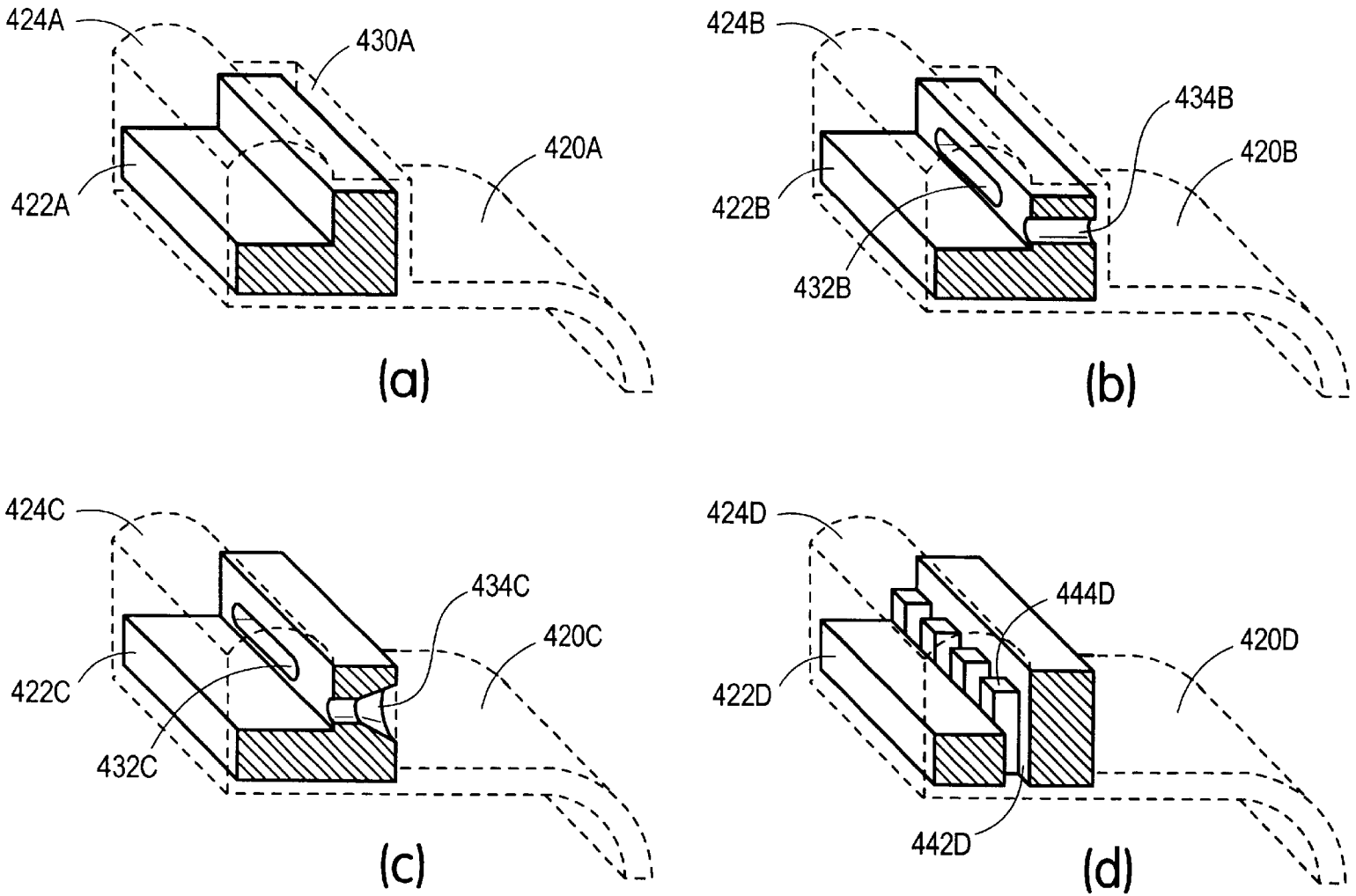
FIGS. 9(*a*) through 9(*d*) are partial views of short sections of the substrate and over-molded seal, illustrating techniques that may be applied to prevent separation of the over-molded seal from the substrate during manufacture.

FIG. 9 depicts additional aspects of the over-molding process used to create the elastomeric bags and gland seals. Over-molding is a well known, two step, fabrication process in which a rigid host substrate is first formed, typically by injection molding. Thereafter, in a second step, a layer of elastomer is molded onto the substrate typically by thermoset or thermoplastic injection molding.

Two over-molding methods are commonly used. The first is used for over-molding onto rigid thermoplastics. In this process, a rigid thermoplastic piece is molded; a thermoplastic elastomer is then over-molded after a section of movable coring is retracted. The thermoplastic part may be required to endure high mold temperatures during the second step of this process.

The second method of over-molding is used to over-mold thermoset elastomer onto either a rigid thermoset or thermoplastic piece. In this process, a rigid piece (thermoset or thermoplastic) is molded using traditional injection molding techniques. The part is then transferred to a second mold cavity wherein the thermoset elastomer is injected onto it. Again, the rigid piece may endure high mold temperatures during the over-mold process.

One problem often encountered when over-molding parts with under cuts and overhangs has been that, when the part is removed from the mold, the mold either tears the elastomer overhang off the elastomer layer or tears the entire elastomer layer off the substrate. Secondly, it has been found that if the elastomer overhang is compressed during assembly, there has been difficulty in supporting it and preventing it from being squashed by the mechanical joint.

To prevent the gland seals from tearing away from the underlying elastomer layer or from the rigid substrate, and to provide structural support to the seal when the regulator bag is assembled, the techniques illustrated in FIG. 9 may be employed. Because of the large number of variables involved in molding a complex shape, the particular techniques required must be determined empirically, through trial and error, for each specific design. The techniques illustrated in FIG. 9 may be employed singly or in combination.

In each of FIGS. 9(*a*) through 9(*d*), a short segment of the rigid host substrate is shown, with the over-molded elastomer shown in phantom. In FIG. 9(*a*), the substrate is shown at 422A, the gland seal at 424A, and a portion of the elastomeric bag at 420A. In FIG. 9(*a*), support is provided to the gland seal by extending the elastomer over the rigid host substrate, as seen at 430A.

In FIG. 9(*b*), the substrate is shown at 422B, the gland seal at 424B, and a portion of the elastomeric bag at 420B. In FIG. 9(*b*), support is provided to the gland seal by both by extending the elastomer 430B over the rigid host substrate, as in 9(*a*), and by providing holes 434B or slots 432B which extend through the rigid host substrate, tying the gland seal to the elastomer on the back side of the substrate (holes or slots may alternatively or additionally be formed through the other 'arm' of the L shaped substrate, tying the gland seal to the elastomer on the bottom of the substrate).

In FIG. 9(*c*), the substrate is shown at 422C, the gland seal at 424C, and a portion of the elastomeric bag at 420C. In FIG. 9(*c*), rather than extending the elastomer over the rigid host substrate, as in 9(*a*) and 9(*b*), reverse drafted supports are provided to the gland seal, which may comprise either holes 434C or slots 432C. The back portions of the holes or slots are oversized and are filled with elastomer during the molding process, thus serving to anchor the gland seal.

In FIG. 9(*d*), the substrate is shown at 422D, the gland seal at 424D, and a portion of the elastomeric bag at 420D. In FIG. 9(*d*), the rigid host substrate is provide with a plurality of castellations 444D and apertures 442D. The castellations support the gland seal, prevent the gland seal from being squashed down during mating , and hold it in position during operation of the regulator bag. The apertures 442D between the castellations serve to anchor the gland seal to the elastomer layer beneath the rigid host support (the apertures may alternatively or additionally be formed through the other 'arm' of the L shaped substrate, with elastomer extending over the substrate as in 9(*a*) and 9(*b*), tying the gland seal to the elastomer on the back of the substrate).

Figure 10:
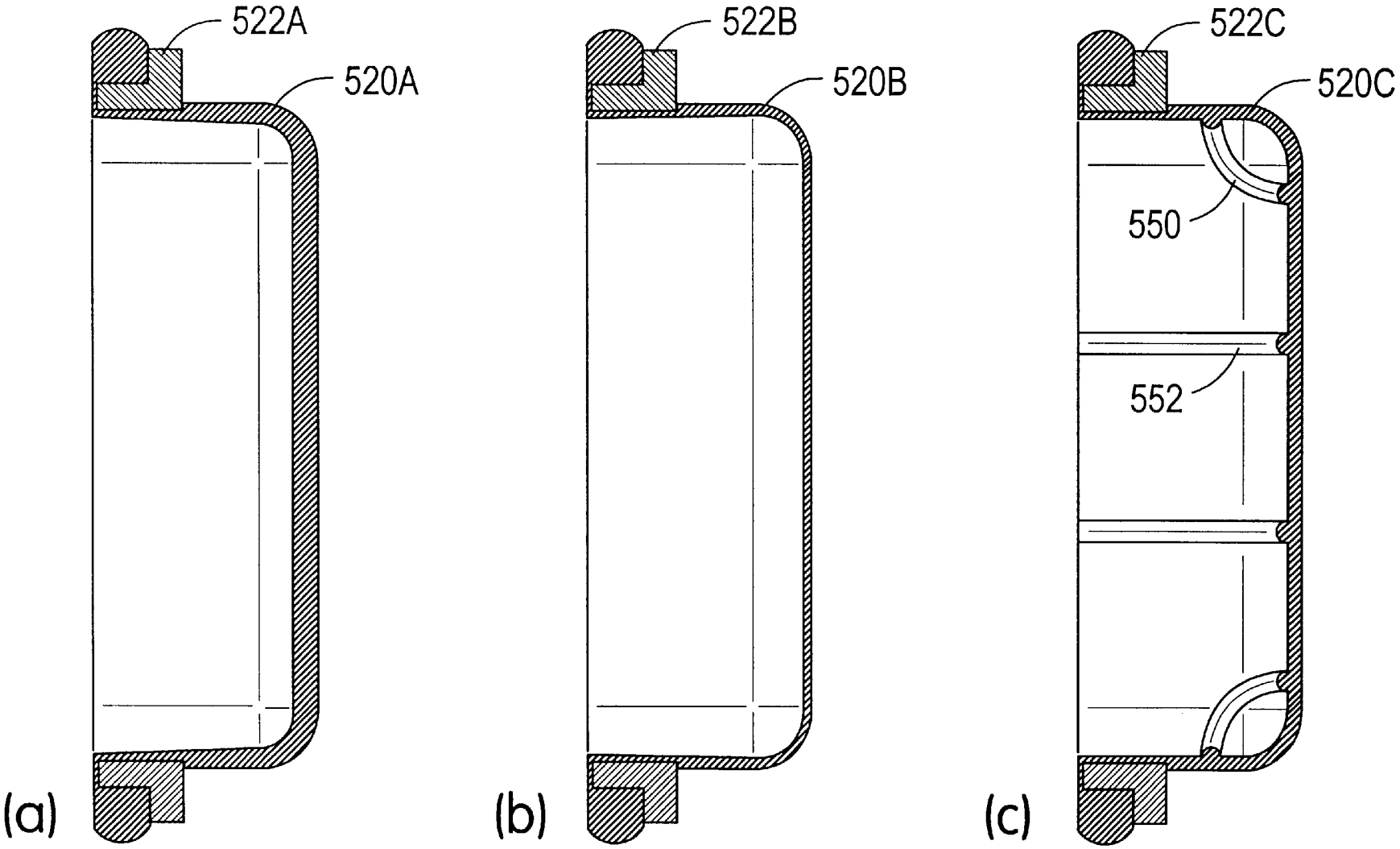
FIGS. 10(*a*) through 10(*c*) illustrate how the present invention allows the production of regulator bags with different performance characteristics.

FIG. 10 illustrates how the over-molding method of the present invention may be used to create regulator bags having different operating characteristics, such as differing moments of inertia. As shown in FIG. 10(*a*), the elastomer bag 520A may be thickened, increasing its resistance to flexing; or, as shown in FIG. 10(*b*), the bag 520(*b*) may be made thinner, making it more flexible. Ribs 550, 552 may be designed into the bag 520(*c*), as shown in FIG. 10(*c*), providing local stiffening and additional design options.

The preferred material for forming the over-molded portion of the regulator bag is silicone rubber, although other resilient elastomeric materials, such as ethylene polypropylene diene monomer (EDPM), may also be used. While the characteristics will vary with the design of the regulator bag, in one over-molded gland seal actually constructed, the critical parameters and dimensions were:

Material: Silicone rubber

Durometer: 70 shore A

Diameter of gland seal: 0.93 mm

Width of slots through substrate: 0.60 mm

Compressibility of the gland seal: 29% diametral compression

While described with respect to inkjet printer regulator bags, the methods and components of the present invention may be adapted to other uses, both in the art of inkjet printing and in other fields, including, but not limited to: ink bladders, supply reservoirs, or pump chambers for ink delivery systems; or reservoirs or pumps for other liquids or gases.

The above is a detailed description of particular embodiments of the invention. It is recognized that departures from the disclosed embodiments may be within the scope of this invention and that obvious modifications will occur to a person skilled in the art. It is the intent of the applicant that the invention include alternative implementations known in the art that perform the same functions as those disclosed. This specification should not be construed to unduly narrow the full scope of protection to which the invention is entitled.

The corresponding structures, materials, acts, and equivalents of all means or step plus function elements in the claims below are intended to include any structure, material, or acts for performing the functions in combination with other claimed elements as specifically claimed.

What is claimed is:

1. A component for a fluid delivery system, comprising:

a) a substrate formed of a rigid material, the substrate having a periphery substantially surrounding an open area, the substrate further having a thickness and anchoring feed-through features piercing the thickness, the anchoring features adapted to receive elastomeric material; and b) a resilient bladder of an elastomeric material over-molded on the substrate, the bladder substantially spanning the open area.

2. The component for a fluid delivery system of claim 1, wherein the anchoring feed-through features comprise a plurality of holes.

3. The component for a fluid delivery system of claim 1, wherein the anchoring feed-through features comprise slots.

4. The component for a fluid delivery system of claim 1, wherein the substrate further comprises a surface, the surface having castellations formed thereon, and the anchoring feed-through features comprise apertures dispersed among the castellations.

5. A regulator bag for a fluid delivery system, comprising:

a) a substantially rigid supporting structure;

b) at least one resilient bag member having 1) a substrate formed of a rigid material, the substrate having a periphery substantially surrounding an open area, the substrate further having a thickness and anchoring feed-through features piercing the thickness, the anchoring features adapted to receive elastomeric material, and 2) a resilient bladder of an elastomeric material over-molded on the substrate, the bladder substantially spanning the open area;

c) a fluidic seal between the periphery of the at least one resilient bag member and the supporting structure.

6. The regulator bag for a fluid delivery system of claim 5, wherein the anchoring feed-through features comprise a plurality of holes.

7. The regulator bag for a fluid delivery system of claim 5, wherein the anchoring feed-through features comprise slots.

8. The regulator bag for a fluid delivery system of claim 5, wherein the substrate further comprises a surface, the surface having castellations formed thereon, and the anchoring feed-through features comprise apertures dispersed among the castellations.

9. The regulator bag for a fluid delivery system of claim 5, further comprising a gland seal of an elastomeric material over-molded on the periphery of the bag member substrate, the gland seal providing the fluidic seal between the bag member and the supporting structure.

10. A regulator bag for a fluid delivery system, comprising:

a) substantially rigid supporting means;

b) at least one resilient bag member having 1) substrate means formed of a rigid material, the substrate means having a periphery substantially surrounding an open area, 2) bladder means of an elastomeric material over-molded on the substrate, the bladder substantially spanning the open area, and 3) the bag member substrate further having a thickness and anchoring feed-through features piercing the thickness, the anchoring features adapted to receive elastomeric material;

c) fluid seal means between the periphery of the at least one resilient bag member and the supporting structure.

11. A regulator bag for a fluid delivery system, comprising:

a) substantially rigid supporting means;

b) at least one resilient bag member having 1) substrate means formed of a rigid material, the substrate means having a periphery substantially surrounding an open area, 2) bladder means of an elastomeric material over-molded on the substrate, the bladder substantially spanning the open area, and 3) the bag member substrate further having a thickness and anchoring feed-through features piercing the thickness, the anchoring features adapted to receive elastomeric material, the anchoring feed-through features comprising a plurality of holes;

c) fluid seal means between the periphery of the at least one resilient bag member and the supporting structure.

12. A regulator bag for a fluid delivery system, comprising:

a) substantially rigid supporting means;

b) at least one resilient bag member having 1) substrate means formed of a rigid material, the substrate means having a periphery substantially surrounding an open area, 2) bladder means of an elastomeric material over-molded on the substrate, the bladder substantially spanning the open area, and 3) the bag member substrate further having a thickness and anchoring feed-through features piercing the thickness, the anchoring features adapted to receive elastomeric material, the anchoring feed-through features comprising slots;

c) fluid seal means between the periphery of the at least one resilient bag member and the supporting structure.

13. A regulator bag for a fluid delivery system, comprising:

a) substantially rigid supporting means;

b) at least one resilient bag member having 1) substrate means formed of a rigid material, the substrate means having a periphery substantially surrounding an open area, 2) bladder means of an elastomeric material over-molded on the substrate, the bladder substantially spanning the open area, and 3) the bag member substrate further having a thickness and anchoring feed-through features piercing the thickness, the anchoring features adapted to receive elastomeric material, 4) the substrate further comprising a surface, the surface having castellations formed thereon, and the anchoring feed-through features comprising apertures dispersed among the castellations;

c) fluid seal means between the periphery of the at least one resilient bag member and the supporting structure.

14. A regulator bag for an inkjet pen, comprising:

a) a substantially rigid hollow supporting structure having two ends, the structure open on the two ends;

b) two resilient bag members, each bag member having 1) a substrate formed of a rigid material, the substrate having a periphery substantially surrounding an open area, and 2) a resilient bladder of an elastomeric material over-molded on the substrate, the bladder substantially spanning the open area;

c) each of the two open ends of the hollow supporting structure closed by one of the two bag members, with a fluidic seal between the periphery of the each of the bag members and the supporting structure;

d) a gland seal of an elastomeric material over-molded on the periphery of the bag member substrate, the gland seal providing the fluidic seal between the bag member and the supporting structure.

15. The regulator bag for an inkjet pen of claim 14, wherein each of the two open ends of the hollow supporting structure further has an interior inward facing surface, the fluidic seal between each bag member and supporting structure formed by compression of the gland seal against the inward facing surface.

16. A regulator bag for an inkjet pen, comprising:

a) a substantially rigid hollow supporting structure having two ends, the structure open on the two ends;

b) two resilient bag members, each bag member having 1) a substrate formed of a rigid material, the substrate having a periphery substantially surrounding an open area, and 2) a resilient bladder of an elastomeric material over-molded on the substrate, the bladder substantially spanning the open area, the elastomeric material of the over-molded bladder consisting essentially of silicone rubber;

c) each of the two open ends of the hollow supporting structure closed by one of the two bag members, with a fluidic seal between the periphery of the each of the bag members and the supporting structure.

17. A regulator bag for an inkjet pen, comprising:

a) a substantially rigid hollow supporting structure having two ends, the structure open on the two ends;

b) two resilient bag members, each bag member having 1) a substrate formed of a rigid material, the substrate having a periphery substantially surrounding an open area, and 2) a resilient bladder of an elastomeric material over-molded on the substrate, the bladder substantially spanning the open area, the elastomeric material of the over-molded bladder consisting essentially of ethylene polypropylene diene monomer (EPDM);

c) each of the two open ends of the hollow supporting structure closed by one of the two bag members, with a fluidic seal between the periphery of the each of the bag members and the supporting structure.

18. A method of forming a regulator bag for a fluid delivery system, comprising:

a) forming a substantially rigid frame structure having a periphery and a substantially open interior, the rigid frame structure having a thickness and anchoring feed-through features piercing the thickness;

b) over-molding an elastomeric material on the substantially rigid frame member to form a resilient bladder substantially spanning the open interior, the over-molding substantially filling the anchoring feed-through features.

19. The method of forming a regulator bag for a fluid delivery system of claim 18, wherein the anchoring feed-through features comprise a plurality of holes.

20. The method of forming a regulator bag for a fluid delivery system of claim 18, wherein the anchoring feed-through features comprise slots.

21. The method of forming a regulator bag for a fluid delivery system of claim 18, wherein the step of forming the substantially rigid frame further comprises forming castellations on the frame, and wherein the feed through features comprise apertures dispersed among the castellations.

22. A method of forming a regulator bag for an inkjet pen, comprising:

a) forming a substantially rigid hollow supporting structure having two ends, the supporting structure open on the two ends;

b) forming two rigid frames, the frames each having a periphery substantially surrounding an open area, and c) over-molding resilient bladders on the rigid frames, the bladders substantially spanning the open areas of the frames;

d) closing the open ends of the hollow supporting structure by fluidically sealing one of the over-molded frames to each of the open ends.

* * * * *